US005570728A

United States Patent [19]

Benedict et al.

[11] Patent Number: 5,570,728

[45] Date of Patent: Nov. 5, 1996

[54] WIRE FEEDING AND CUTTING MACHINE

[75] Inventors: Roger J. Benedict; Craig S. Legaul, both of Rockford, Ill.

[73] Assignee: Fastener Engineers Group, Inc., Rockford, Ill.

[21] Appl. No.: 546,604

[22] Filed: Oct. 23, 1995

[51] Int. Cl.[6] ..... B21F 11/00

[52] U.S. Cl. ..... 140/140; 83/80

[58] Field of Search ..... 140/140; 83/80, 83/102, 159

[56] References Cited

U.S. PATENT DOCUMENTS 1,909,012 5/1933 Roberts .
1,911,150 5/1933 Hallden .
1,925,845 9/1933 Moore .
1,982,383 11/1934 Hallden .
2,101,860 12/1937 Lewis et al. .
2,213,650 9/1940 Grimshaw .
3,237,829 3/1966 Muntwyler .
3,515,021 6/1970 Walus et al. .

*Primary Examiner*—Lowell A. Larson
*Attorney, Agent, or Firm*—Vernon J. Pillote

[57] ABSTRACT

A wire feeding and cutoff machine in which the feed mechanism continuously advances wire along a path past a wire cutoff arm and into an elongated wire guide having a stationary guide member and a movable closure member. The cutoff arm is pivotally mounted on a cutoff arm axis and is driven by a crank connected to the output shaft of a one-revolution clutch. The crank drives the cutoff arm and moves a cutter downwardly from an initial position and then back to clear the wire path during a first half of the crank revolution. A drive mechanism for the movable closure member is connected to the cutoff and moves movable closure to an open position in response to movement of the cutoff arm in a cutting stroke and to a closed position during movement of the cutoff arm in the return. The drive mechanism also operates an ejector pin for ejecting a wire from the wire guide when the movable closure member is opened.

30 Claims, 6 Drawing Sheets

66a'
65a'
65a
67
51
65a"
66a"
53
52
66a
65a'
67
57
56
62
58
55
61
62a
66a
65a
69
68
86a
92
87
91
85
38
88
39
52
56

FIG. 7
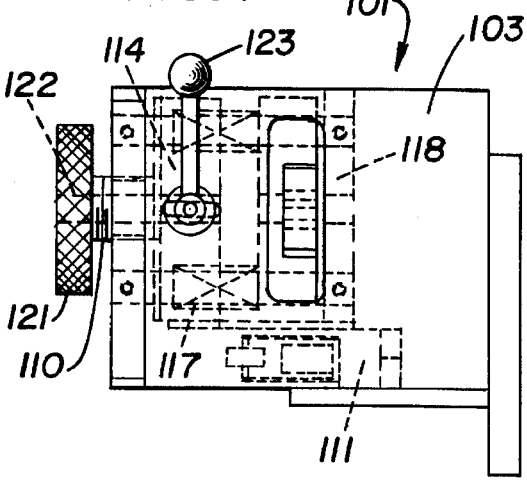
FIG. 8
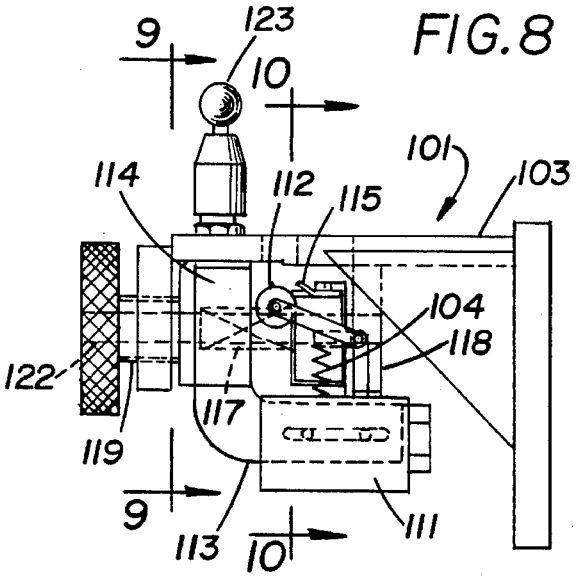
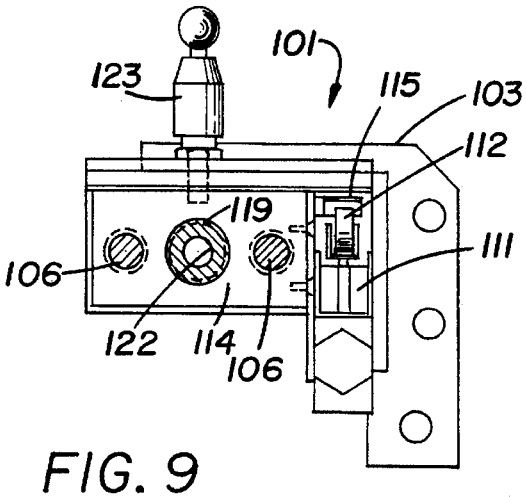
FIG. 9
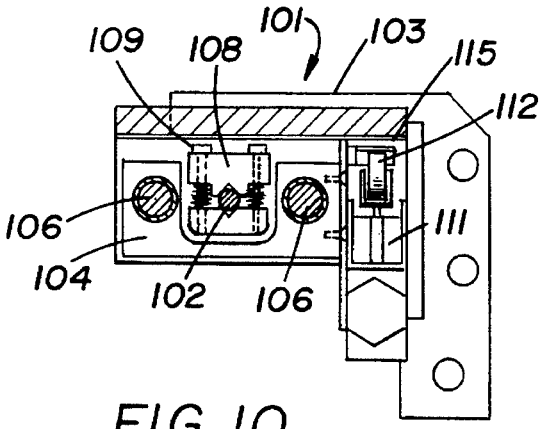
FIG. 10
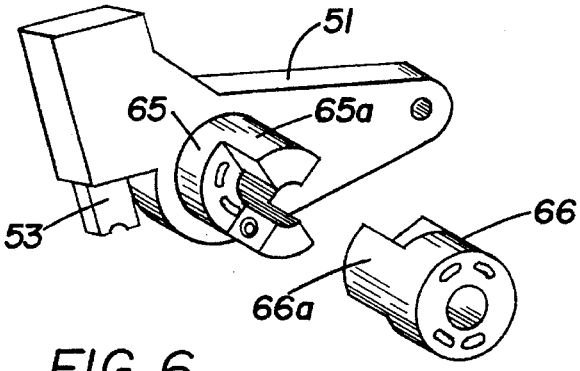
FIG. 6

WIRE FEEDING AND CUTTING MACHINE

BACKGROUND OF THE INVENTION

The present invention relates to a machine for continuously feeding wire and cutting the wire into preselected lengths for subsequent processing. In general, wire straightening and cutting machines include wire straightening mechanism and feed mechanism for feeding the wire past a wire cutoff and into an elongated wire guide. The cutoff mechanism is actuated to sever the wire when a preselected length is fed into the wire guide and the cutoff guide is opened to laterally discharge the length of wire from the guide. The machines are used to cut wire lengths that vary from a few decimeters to three or more meters. The cycle time of the feeding and cutting machine can be decreased by increasing the speed of wire feed, particularly on long wire lengths. However, increasing the speed of wire feed aggravates the problems encountered in cutting the wire.

Some prior wire straightening and cutoff machines such as disclosed in U.S. Pat. Nos. 1,909,012; 1,982,383; 2,101,860; 2,213,650 and 3,237,829, provide a cutoff mechanism or shear that can move in the direction of the wire feed during cutting. This not only complicates the machine but also introduces some other problems. U.S. Pat. Nos. 1,911,150; 1,925,845 and 3,515,021, provide cutoff mechanisms that are fixed in the direction of wire feed. In such machines, the advance of the wire is interrupted while the cutoff blade moves crosswise of the wire path in a cutting stroke and until the blade has moved clear of the wire path. When the advance of the wire is interrupted by the cutoff mechanism, the rotary wire straightener continues to work the wire while the feed rolls slide relative to the wire and can damage the wire depending on the speed of the wire feed and the interval that the wire advance is interrupted by the cutoff mechanism.

It is desirable to minimize the time that wire advance is interrupted by the cutoff mechanism during a cutoff operation. It is also important that the wire guide be rapidly moved to an open position to discharge the wire after cutting and, that the wire guide be rapidly moved back to a closed condition for guiding the next section of wire, as soon as the wire has been discharged from the guide. In U.S. Pat. No. 3,515,021 a cutter arm 54 is mounted for oscillation with the shaft 41 that operates the movable closure member. The cutter arm and the movable closure member are oscillated in unison by an eccentric driven from a motor through a one-half revolution type indexing clutch mechanism. The wire guide and closure operating shaft must be sufficiently long to accommodate the maximum length of wire being cut, and the closure and closure operating shaft in conjunction with the cutter and eccentric drive, present a high inertia load that is reflected back to the clutch mechanism at the start of each half revolution of the clutch output shaft. High inertia loads can produce rapid wear and/or premature failure of the indexing clutch when operated at high speeds.

SUMMARY OF THE INVENTION

The general object of the present invention is to provide a wire feeding and cutting machine which can be operated at high wire feed and cutoff speeds, and which overcomes problems encountered in prior wire straightening and cutting machines by providing a mechanism driven through a one revolution type clutch-brake unit for operating the wire cutter and movable closure member at high speed while reducing reflected inertia loads on the clutch-brake unit.

Accordingly, the present invention provides a wire feeding and cutoff machine in which the wire feed mechanism continuously advances wire along a wire path through a cutoff die and into an elongated wire guide having a stationary guide member and a movable closure member. A wire cutoff arm is mounted for angular movement about a cutoff arm axis paralleling the wire path and the cutoff arm is driven by an eccentric connected to the output shaft of a one-revolution clutch. The eccentric drives the cutoff arm from an initial position in a first angular direction to move the cutter at least part way across the wire path in a cutting stroke and then in a second angular direction to a position clearing the wire path, and closure operating mechanism is provided for moving the movable closure member between open and closed positions in response to angular movement of the cutoff arm. The closure operating mechanism for moving the movable closure member includes a drive member mounted on the cutoff arm for angular movement with the cutoff arm and a driven member mounted for limited angular lost motion relative to the drive member and operatively connected to a closure operating shaft for moving the movable closure member to an open position in response to turning of the driven member. The closure operating mechanism for the movable closure is constructed and arranged to start turning the operating shaft after the cutoff arm has moved from its initial position through a delay angle that is at least sufficient to allow the output shaft of the clutch-brake mechanism to reach the speed of the input shaft. The drive and driven members are also advantageously arranged such that the drive member does not drivingly engage the driven member during movement of the cutoff arm in the second half of the revolution of the clutch output shaft.

In accordance with another aspect of the present invention, one or more wire ejector pins are provided on the wire guide intermediate the ends of the stationary guide member, for aiding ejection of the wire from the guide passage when the movable closure member is in its open position. The ejector pin or pins are advantageously actuated by means responsive to angular movement of the driven member.

BRIEF DESCRIPTION OF THE DRAWINGS

FIG. 6 is an exploded perspective view of the cutoff arm and closure drive member;

FIG. 7 is a plan view of the wire gauge mechanism for controlling actuation of the one-revolution clutch;

FIG. 8 is a side view of the gauge mechanism;

FIG. 9 is a fragmentary transverse sectional view taken on the plane 9—9 of FIG. 8;

FIG. 10 is a fragmentary transverse sectional view taken on the plane 10—10 of FIG. 8.

DETAILED DESCRIPTION

Figure 1:
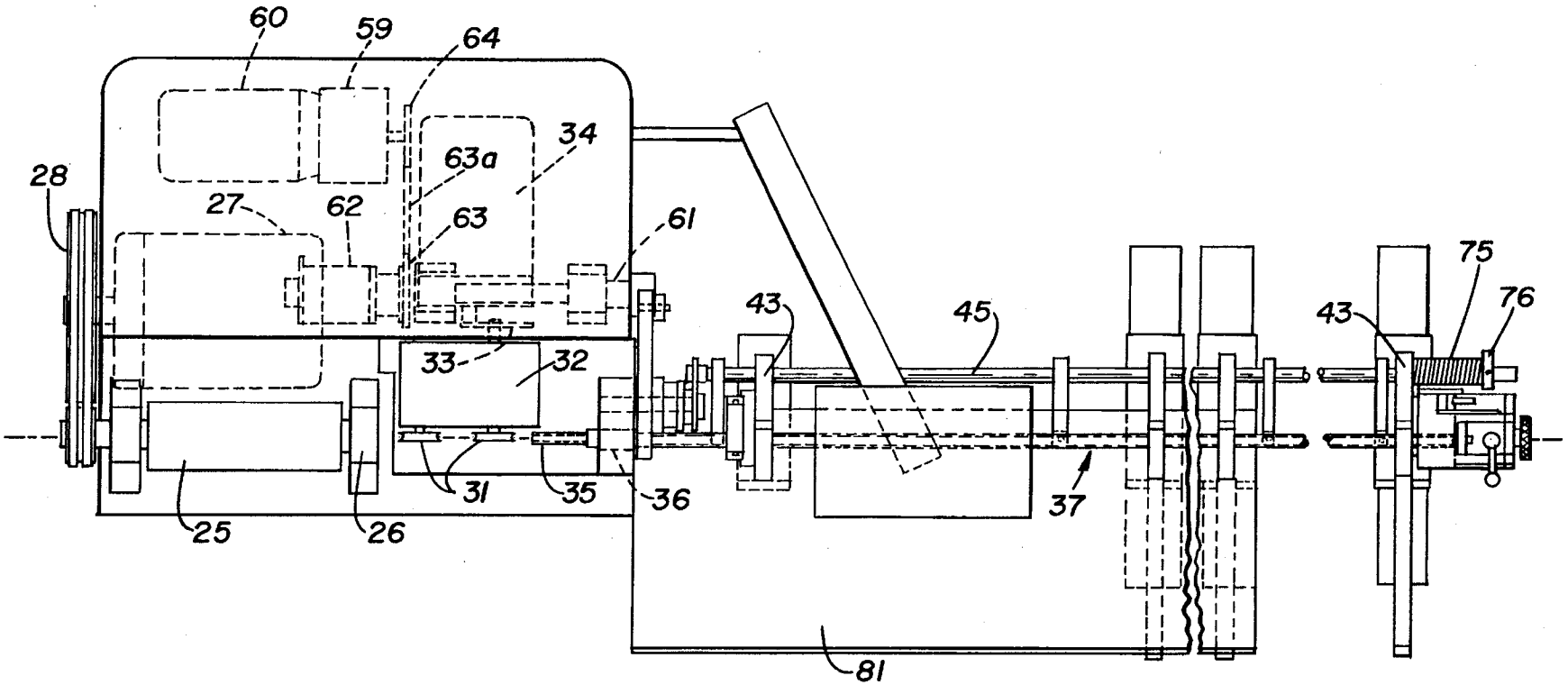
FIG. 1 is a plan view of the wire straightening, feeding and cutoff machine.
Figure 2:
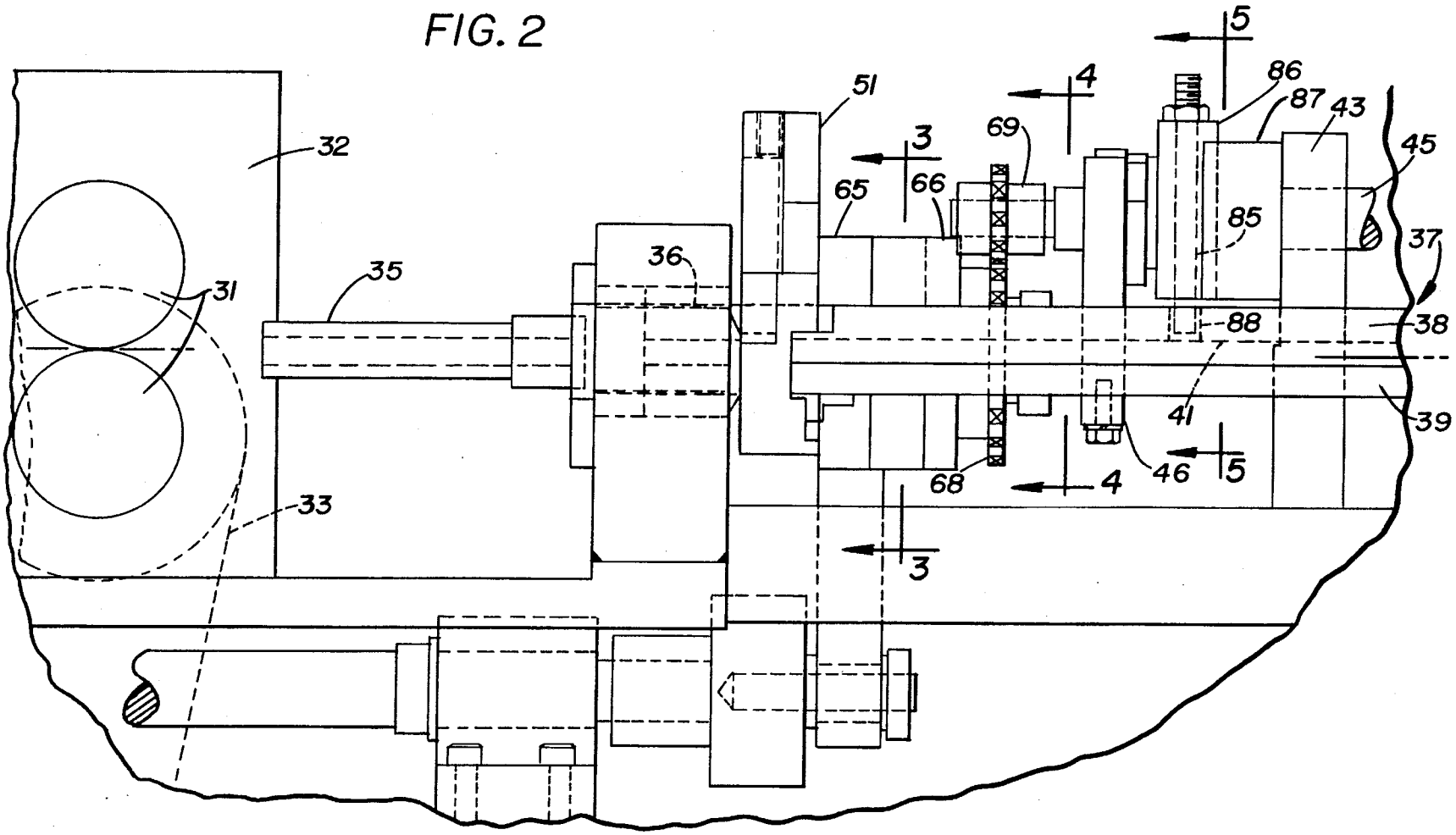
FIG. 2 is a fragmentary side view on a larger scale that FIG. 1.

As best shown in FIGS. 1 and 2, the wire straightening and cutoff machine includes a wire straightener 25 conveniently in the form of a rotary type straightener supported in bearings 26 and driven by a motor 27 through a belt and pulley drive 28. The wire is advanced by a feed mechanism herein shown in the form of opposed pairs of grooved feed rollers 31 mounted on a drive box 32 and drivingly connected as through a chain and sprocket drive 33 to a feed roll drive motor 34. Drive motors 27 and 34 are preferably of the variable speed type to enable adjustment of the speed of the rotary straightener 25 and the speed of the roller feed rolls 31 to accommodate different types and sizes of wire.

The feed rolls advance the wire through a quill 35 and stationary cutoff die 36 and into an elongated wire guide 37. The wire guide 37 includes a stationary guide member 38 and a movable closure member 39 (FIG. 2) and a wire guide passage 41 is formed at the interface between the stationary guide and movable closure members. The movable closure member 39 is operative when closed to guide the wire lengthwise of the passage and, when open, to allow lateral discharge of the wire from the guide passage. The stationary wire guide member 38 is mounted by stationary supports 43 on a support frame structure and the movable closure guide member 39 is operatively connected to a closure operating shaft 45 that parallels the wire guide and which is arranged to move the movable closure member 39 between open and closed positions in response to angular movement of the closure operating shaft 45. In the embodiment illustrated, the movable closure member 39 is supported by arms 46 for angular movement with the closure operating shaft 45 between a closed position and an open position.

Figures 3, 4, 5:
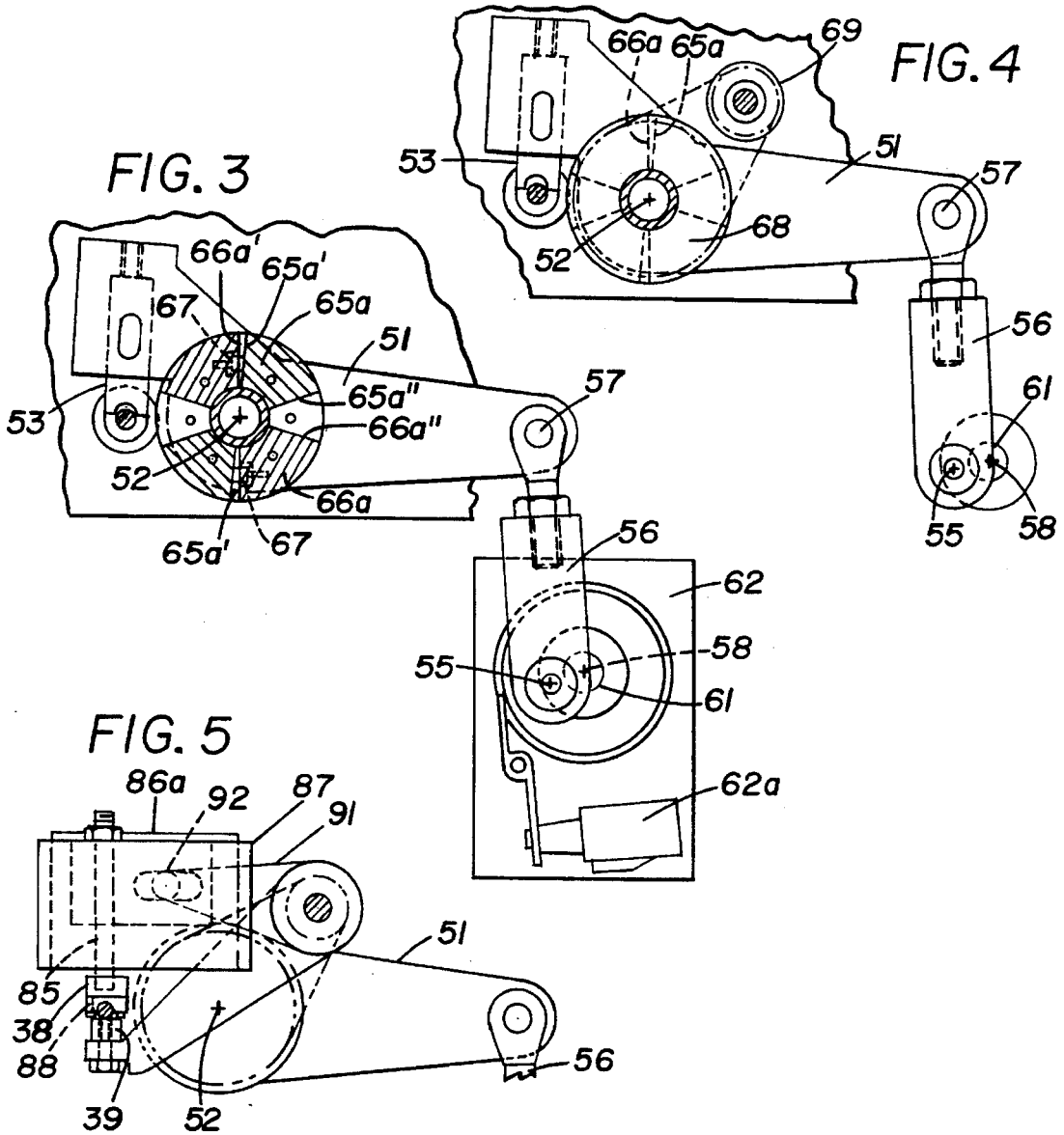
FIG. 3 is a fragmentary transverse sectional view taken on the plane 3—3 of FIG. 2.
FIG. 4 is a fragmentary sectional view taken on the plane 4—4 of FIG. 2.
FIG. 5 is a fragmentary transverse sectional view taken on the plane 5—5 of FIG. 2.

As best shown in FIGS. 3 and 4, a wire cutoff arm 51 is mounted for pivotal movement above a cutoff arm axis 52 parallel to the wire path and a cutter 53 is mounted on one end of the cutoff arm for movement crosswise of the cutoff die 36, and the cutoff arm is driven by an eccentric 55 through a link 56 pivotally connected at 57 to a second end of the cutoff arm. As best shown in FIG. 4, the eccentric comprises a crank pin mounted for rotation about a crank axis 58 and the eccentricity of the eccentric and the proportions of the cutoff arm are selected to move the cutter 53 through a cutting stroke slightly greater than the maximum size of the wire to be cut on the machine. As shown in FIG. 4, the length of the cutoff arm between the cutoff arm axis 52 and pin 57 is substantially greater than the distance between the cutter 53 and the axis 52 and such that the stroke of the cutter is smaller than the crank stroke.

The eccentric 55 is driven from the output shaft 61 of a one revolution clutch-brake unit 62. As schematically illustrated in FIG. 1, the one-revolution clutch has an input shaft (not shown) connected through a sprocket 63, chain **63*a* and sprocket 64 to a cutoff drive motor 60 through a speed reducer 59. The cutoff drive motor can be a fixed speed motor that is preferably a variable speed type electrical motor, and the speed reducer is provided to reduce the speed at which the input shaft of the one-revolution clutch brake unit is driven. The clutch-brake unit preferably is of the type having an electroresponsive actuator 62*a* which is operative, when actuated, to drivingly connect the clutch input shaft to a clutch output shaft 61** and drive the latter through one revolution. Such clutch-brake mechanisms are well known and detailed description of the construction and operation is deemed unnecessary. The clutch-brake units may for example be of the wrap-spring type.

The crank and clutch are arranged to drive the cutoff arm from an initial cutter position in which the cutter 53 is spaced from one side of the wire path through a cutting stroke and back to the initial position during each revolution of the output shaft. In the preferred embodiment, the crank 55, link 56 and cutter arm 51 are advantageously arranged to drive the cutter during each revolution of the clutch output shaft, from an initial cutter position above the wire path in a first direction crosswise of the wire path to a cutter bottom position, and then in the opposite angular direction from the bottom position through an intermediate position in which the cutter clears the wire path during approximately one-half of the crank revolution. During the second half of each revolution, the crank continues to move the cutoff arm in said second angular direction from the intermediate position to an upper position above the wire path and then in the first angular direction from the upper position back to the initial position at the end of one revolution. In order to reduce the inertia load of the eccentric, closure operating shaft 45, and cutoff arm that is reflected back to the clutch-brake unit upon start of the clutch cycle, the cutoff arm is preferably adjusted relative to the link 56 and the cutter is adjusted relative to the cutoff arm such that the cutter does not initially contact the wire and movement of the movable closure member is not commenced until after the clutch output shaft 61 has reached the speed of the input shaft. Some indexing type clutch-brake units such as wrap-spring type clutch-brake units, have a delay time of three or four milliseconds between actuation of the clutch and the time the output shaft comes up to speed, and the link and cutter are preferably adjusted so as to provide a minimum time delay between actuation and start of the cut, that is greater than the clutch time delay. The position of the cutter and the position of the eccentric at the start of each cycle is also advantageously arranged such that the cutter moves at maximum cutter velocity at the start of the cut.

Figure 12:
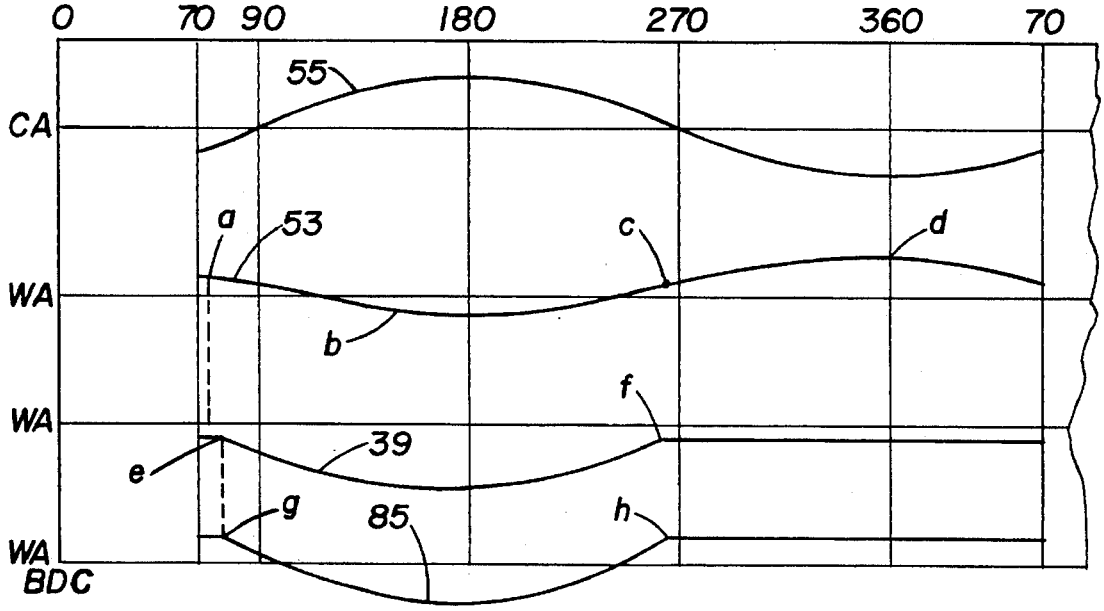
FIG. 12 is a timing diagram illustrating movement of the crank, cutter, closure member and ejector, when the clutch-brake is arranged to start a cycle at about 70° after crank bottom dead center.

FIG. 12 is a timing diagram which graphically illustrates the timing and relative amplitudes of movement of the cutter 53, the movable closure member 39 and the ejector 85 by the eccentric 55, when the clutch is arranged to start a cycle at crank position about 70° after crank bottom dead center. The curve labeled 55 in FIG. 12, schematically illustrates movement of the eccentric 55 relative to the crank axis labeled CA. When the cutter arm 51 is its initial position as shown in FIG. 4, the cutter 53 is spaced above the wire axis designated WA in FIG. 12, a distance such that the cutter is above the wire path. As the crank rotates in a clockwise direction as viewed in FIG. 4, the crank arm moves in a first angular direction in which the cutter moves downwardly and after a selected time delay, for example four or five milliseconds, the cutter makes initial contact with the wire as indicated at a in the line designated cutter in FIG. 12. Angular movement of the cutter in the first direction is continued until the cutter reaches cutter bottom position indicated at b, and the direction of angular movement of the cutoff arm then changes to a second direction and the cutter moves upwardly and clears the wire path at a cutter position designated b. Angular movement of the cutoff arm in the second direction continues until top position of the cutter designated d and the cutoff arm thereafter moves in the first direction back to the initial position.

Figure 13:
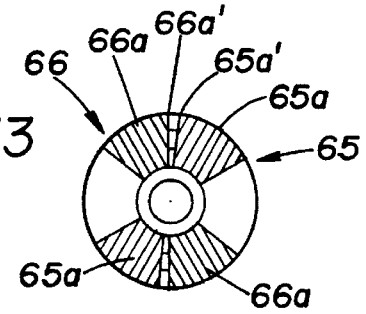
FIG. 13 is a sectional view through the drive and driven members at the start of the cycle illustrated in FIG. 12.

Drive means are provided for turning the guide operating shaft 45 in response to angular movement of the cutoff arm to effect accurate timing of the opening and closing of the wire guide with the cutting operation. For this purpose, a drive member 65 having drive dogs 65*a* (FIGS. 3, 4 and 6), is mounted on the cutoff arm 51 for angular movement with the cutoff arm about the cutoff arm axis 52, and a driven member 66 having driven dogs 66*a* is mounted for angular movement about an axis coaxial with the cutoff arm axis and for limited angular lost motion relative to the drive member. The driven member is operatively connected to the closure operating shaft 45 for turning the operating shaft to move the movable closure member to the open position. In the preferred embodiment illustrated in FIGS. 2, 4 and 5, a sprocket 68 is mounted on the driven member and connected through a chain to a sprocket 69 on the closure operating shaft 45. Sprocket 68 is selected to have a larger pitch diameter than sprocket 69 to rotate the closure operating shaft through an angle substantially greater than the angular movement of the cutoff arm, to fully open the closure member. The driven member and closure operating shaft move angularly less than 90° and can be operatively interconnected by a link connected to arms on the driven member and operating shaft, if desired. As best shown in FIGS. 4 and 5, the drive and driven dogs are arranged to interfinger with a face 65*a*' of drive dog 65*a* arranged to engage a face 66*a*' of drive dog 66*a* when the cutoff arm is moved in a first angular direction from the initial cutter position. The drive and driven members are connected to the respective cutoff arm and sprocket 68 through fasteners, that extend through angularly elongated slots in one of the interconnected members to enable angular adjustment of the drive member relative to the cutoff arm and the driven member relative to the sprocket 68. As shown in FIGS. 3, 13 the drive and driven dogs are adjusted such that, when the cutoff arm is in its initial position shown in FIG. 3, the drive face 65*a*' on the drive dog is spaced a small angle from the face 66*a*' on the driven dog 66*a*, such that the cutoff arm moves through a small angle before the drive dog engages and starts driving the driven member. Thus, as will be seen from the curve labeled 39 in FIG. 12, movement of the movable closure member 39 does not start for a time delay designated e after the start of a crank cycle, which time delay is greater than the cutter start time delay to reduce inertial loads reflected back to the clutch. The movable closure member is then moved angularly to an open position as the cutoff arm moves in a first angular direction to the bottom position b of a cutting stroke. The movable closure member is yieldably urged to a closed position by the resilient means such as a spring. The spring may for example be a torsion type spring 75 shown in FIG. 1, anchored at one end to a stationary support and at another end to a collar 76 fixed to the closure operating shaft 45. Thus, as the cutter moves from a bottom position b in the opposite angular direction, the drive dogs 65*a* are moved angularly back to the position shown in FIG. 3 and the driven dogs 66*a*' under the bias of the spring 75 follow movement of the drive dogs so that the drive dogs control the rate of angular movement of the closure operating shaft 45 and hence the movable closure member back to a closed position. The faces 65*a*' on the drive dogs move out of engagement with the faces 66*a*' on the driven dogs when the movable closure member returns to its closed position. A pad 67 of resilient elastomeric material (FIG. 3) is advantageously provided in a recess in one of the dog faces such as 66*a*' and arranged to project a short distance outwardly of that face to absorb impact and reduce noise.

As previously described, during the second half of the revolution of the clutch, the cutoff arm moves the cutter 53 through the top cutter position and then back to the initial position. The drive and driven dogs 65*a* and 66*a* have second faces 65*a*" and 66*a*" that are angularly spaced from each other as shown in FIGS. 3 and 4 an angular distance sufficient to remain out of engagement during movement of the cutoff arm during the second half revolution. Thus, the movable closure bar can remain in its closed position during the second half of the crank cycle, as indicated at f in FIG. 12.

Figure 11A:
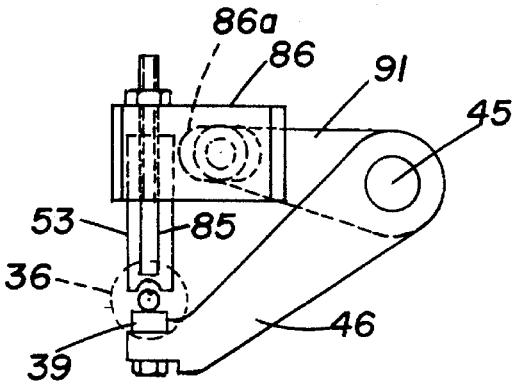
FIGS. 11*a*–11*d* are views diagrammatically illustrating different moved positions of the movable closure member and wire ejector with different angular positions of the cutoff arm.
Figure 11B:
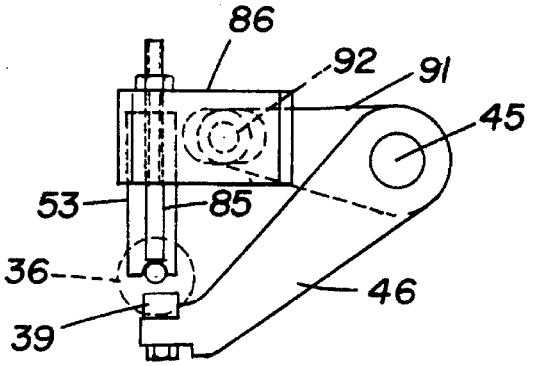
Figure 11C:
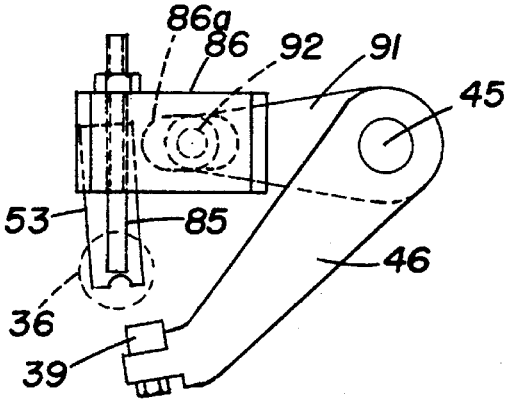
Figure 11D:
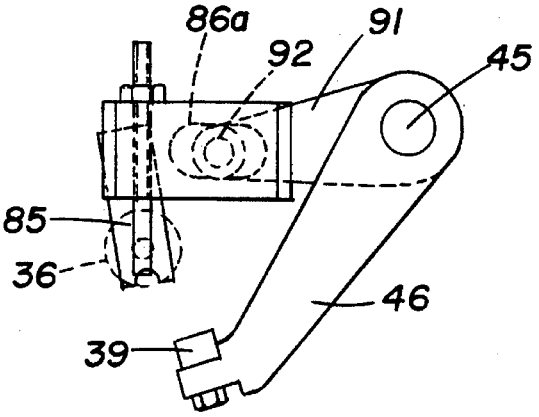
Figure 14:
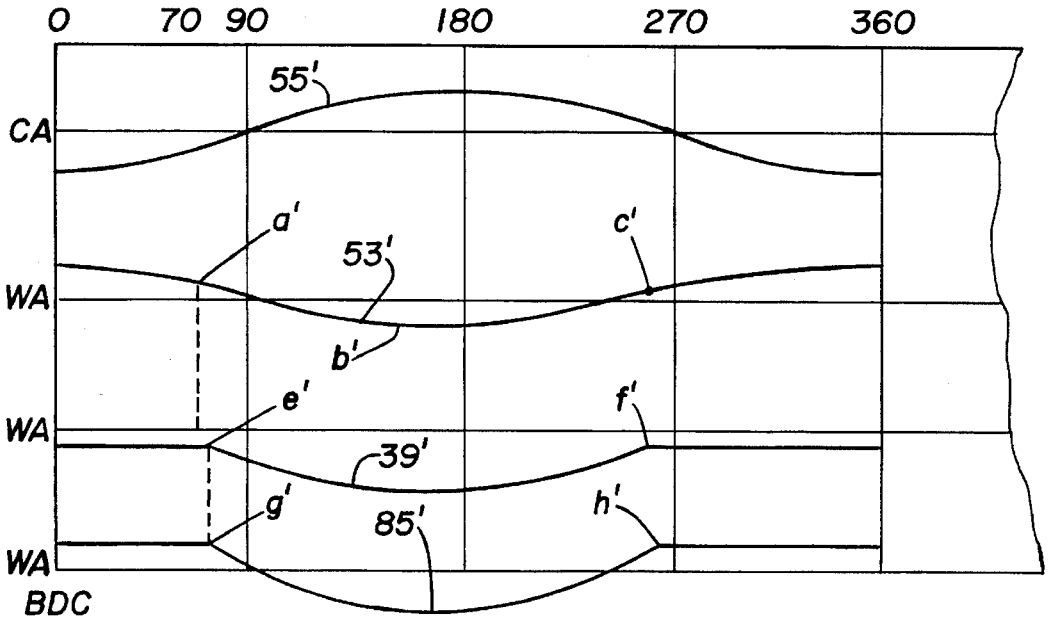
FIG. 14 is a timing diagram illustrating movement of the crank, cutter, closure member and ejector when the clutch-brake is arranged to start a cycle at crank bottom dead center.

The movable closure member underlies the stationary guide member and the guide passage opens downwardly when the movable closure member is in its open position. Thus, the cutoff length of wire is normally gravitationally discharged into a wire receiving basket or tray 81. However, a cutoff length of wire will sometimes fail to fall by gravity and hang up or delay falling from the wire guide passage. To overcome this problem, at least one ejector pin is mounted for movement crosswise of the wire receiving passage at a location intermediate the ends of the stationary wire guide and ejector pin actuating means are provided for moving the ejector pin crosswise of the wire passage in timed relation with the movement of the movable closure member to the open position, to aid in discharging the wire therefrom. It is contemplated that more than one ejector pin can be used, at different locations along the length of the wire guide, particularly in machines for cutting very long lengths of wire. As shown in FIGS. 2 and 5, an ejector pin 85 is mounted on a slide 86 guidably mounted in a guideway 87 conveniently fixed to one of the supports 43 for the closure operating shaft 45. The ejector pin extends through an opening 88 in the stationary guide member 38 for movement crosswise of the wire guide passage. As best shown in FIG. 5 and FIGS. 11*a*–11*d*, the slide 86 is vertically reciprocated by an ejector arm 91 conveniently attached to the closure operating shaft for angular movement therewith. A follower 92 on the ejector arm 91 extends into a horizontally elongated slot 86*a* in the slide 86 to vertically reciprocate the slide in response to angular movement of the closure operating shaft. The ejector pin is vertically adjustable in the slide and, when the cutoff arm is in its initial position, the ejector pin is positioned with its lower end spaced above the wire receiving passage 41 as shown in FIG. 11*a*. As previously described, the closure drive means provides an initial lost motion between the cutoff arm and the angular movement of the closure operating shaft and there is a corresponding initial lost motion between movement of the cutoff arm and movement of the ejector arm as shown by the curve 85 in FIG. 12 graphically illustrating movement of the ejector pin 85. The ejector pin is preferably adjusted on the arm such that the lower end of the ejector pin does not engage the wire in the stationary guide passage until after the cutter has at least substantially severed the wire and the movable closure member has started to move to its open position as shown in FIGS. 11*b* and 11*c*. As shown in FIG. 14, the ejector pin 85 moves from a position q above the wire path, downwardly across the wire path and then back up above the wire path as the movable closure bar moves to an open position and back to a closed position.

The one revolution clutch-brake mechanism 62 has an electroresponsive actuator 62*a*, and an actuator control means 101 is provided at the outlet end of the wire guide for actuating the electroresponsive actuator when a predetermined length of wire is fed into the wire receiving passage. As best shown in FIGS. 8–11, a gauge rod 102 is slidable in the outlet end portion of the gauge passage and extends beyond the end of the wire guide 38. A support bracket 103 is mounted on the machine in fixed relation to the stationary wire guide and a gauge slide 104 is slidably mounted on guide rods 106 for rectilinear movement parallel to the guide passage. A gauge rod clamp 108 is mounted on the gauge slide and is arranged to clamp the gauge rod to the gauge slide as by clamp screws 109. An electrical switch 111 having a switch actuator 112 is mounted by a switch mounting bracket 113, 114 on the guide rods of the support bracket 103 for adjustment relative to the support bracket in a direction paralleling the wire path. A cam 115 is mounted on the slide gauge 104 for movement with the slide gauge. The slide gauge is yieldably urged by springs 117 to a reference position against a stop shoulder 118 and the cam is arranged to engage the switch actuator 112 when the slide gauge is moved away from the reference position. A screw 119 having a hand wheel 121 is threadedly mounted on the support bracket 103 and, preferably, the screw is aligned with the actuator rod in the wire guide passage and has an axial passage 122 therethrough to allow the actuator rod to extend through the screw. Thus, the screw can be turned relative to the stationary bracket 103 to adjust the switch relative to the reference position and a means such as a clamp screw 123 is provided for locking the switch in adjusted position. With this arrangement, a coarse adjustment of the actuator rod position can be made by adjusting the position at which the actuator rod is clamped to the gauge slide and a fine adjustment of the position at which the actuator rod actuates switch 111 can thereafter be made while the machine is in operation, using the adjusting screw 119 and clamp screw 123. As will be seen, the gauge rod clamp 108 can continue to move with the gauge rod 102 after the cam 115 actuates the switch 111, to accommodate advance of the wire by the feed rolls after the clutch is actuated and before the cutter engages the wire in a cutting stroke and stops advance of the wire.

Figure 15:
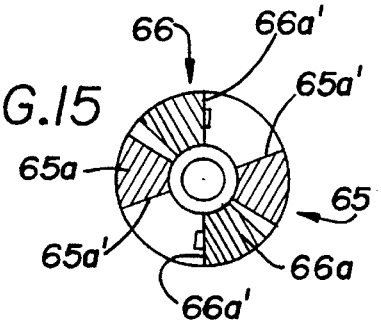
FIG. 15 is a sectional view through the drive and driven members at the start of the cycle illustrated in FIG. 14.

FIG. 14 illustrates a preferred embodiment in which clutch and eccentric are arranged to start a cycle that allows only a short time delay sufficient to enable the clutch to come up to full speed, before the cutter engages the wire. This arrangement minimizes the distance that the wire travels between the time the clutch is actuated and the time the cutter starts to cut. However, the feeding and cutting machine can be adapted for clutch actuation at other times in the crank cycle, for example at crank bottom dead center position as illustrated by the crank curve 55' in FIG. 14. As shown in FIG. 14, when the crank cycle is started at bottom dead center, the initial position of the cutter 53' will be the top cutter position and during a cycle the cutter will move downwardly through a position a' at which it engages the wire to a cutter bottom position b' then upwardly to a position c' at which the cutter clears the wire path and back to the top cutter position. When the crank is at bottom dead center position, the faces 65*a'* of the drive dogs 65*a* are angularly spaced about 70° from the faces 66*a'* of the driven dogs as shown in FIG. 15 so that the drive dogs do not engage and start driving the driven dogs until the crank reaches about 70° after bottom dead center. As indicated by the curves 39' and 85' the closure member 39' starts to move at c' from a closed position to an open position after the cutter engages the wire at a' and the closure member moves back to a closed position indicated at f' as the cutter clears the wire path. Similarly the ejector 85' starts to move down at g' and then back up above the wire path as indicated at h' as the closure reaches its closed position.

From the foregoing, it is believed that the construction and operation of the wire feeding and cutting machine will be readily understood. The machine has been operated at relatively high cutoff speeds. For example at clutch speeds of two hundred eighty RPM, the crank will complete one revolution in about 215 MS. When the machine is timed as shown in FIGS. 12 and 14, the cutter completes a downward cutting stroke and moves upwardly to clear the wire in about one-half of the crank revolution so that the cutter interrupts advance of the wire for only about 115 MS. The cutoff arm moves through only a small angle during a cutoff cycle and, depending on the clutch speed, an angle of one or two degrees between the faces 65*a'* and 66*a'* on the drive and driven members, when the cutoff arm is in its initial position, will generally provide a time delay between start of each crank revolution and the start of movement of the closure operating shaft sufficient to allow the clutch output shaft to reach the speed of the clutch input shaft.

The embodiments of the invention in which an exclusive property or privilege is claimed are defined as follows:

1. A wire feeding and cutoff machine comprising, means for continuously advancing wire through a wire path in a cutoff die, an elongated wire guide defining an elongated wire receiving passage for receiving wire advanced through die and including a stationary guide member and a closure member movable between a closed position for guiding wire in the passage and an open position for discharge of wire laterally from the passage, a cutoff arm mounted for angular movement about a cutoff arm axis paralleling the wire path and a wire cutter mounted on the cutoff arm for movement crosswise of the cutoff die, a drive motor, one-revolution clutch-brake means having an input shaft drivingly connected to the motor and an output shaft and an electroresponsive clutch actuator operable when energized to drive the output shaft with the input shaft through one revolution, and actuator control means including a switch responsive to feeding a predetermined length of wire into the wire receiving passage for actuating the electroresponsive clutch actuator, eccentric means connecting the output shaft to the cutoff arm operable during each revolution of the output shaft for angularly driving the cutoff arm from an initial position in which the cutter is spaced from one side of the wire path through a cycle moving the cutter from the initial position crosswise of the wire path and back to the initial position, the cutoff arm and cutter being constructed and arranged such that the cutter extends across the wire path during a selected portion of each cycle, and closure operating means for moving the closure member from the closed position to the open position and back to the closed position in response to angular movement of the cutoff arm during said portion of the cycle.

2. A wire feeding and cutoff machine according to claim 1 wherein said closure operating means includes a drive member mounted for angular movement with the cutoff arm about the cutoff arm axis, a driven member mounted for angular movement about an axis coaxial with the cutoff arm axis and for limited angular lost motion relative to the drive member and means operatively connecting the driven member to the closure member.

3. A wire feeding and cutoff machine according to claim 1 wherein the closure operating means is constructed and arranged to start moving the closure member to the open condition after the cutoff arm has moved from said initial position through an angle at least sufficient to allow the output shaft of the clutch-brake means to reach the speed of the input shaft.

4. A wire feeding and cutoff apparatus according to claim 1 wherein the cutter and cutoff arm are arranged such that, during movement of the cutoff arm from said initial position, the cutter engages a wire in the cutoff die before the closure operating means starts movement of the closure member to the open condition.

5. A wire feeding and cutoff machine according to claim 1 wherein said closure operating means includes a closure operating shaft extending generally parallel to the wire guide and means operatively connecting the driven member to the closure operating shaft constructed and arranged such that driven member turns the closure operating shaft through an angle substantially greater than the angular movement of the cutoff arm.

6. A wire feeding and cutoff machine according to claim 5 wherein the movable closure member is mounted by support arms on the closure operating shaft for angular movement therewith.

7. A wire feeding and cutoff machine according to claim 5 including at least one ejector pin mounted for movement crosswise of said wire receiving passage at a location intermediate ends of the stationary guide member, and ejector pin actuating means responsive to movement of the driven member for moving the ejector pin across the wire receiving passage in the wire guide and back during said portion of the cycle to aid discharging a wire therefrom.

8. A wire feeding and cutoff machine according to claim 7 wherein the ejector pin actuating means is operatively connected to said closure operating shaft.

9. A wire feeding and cutoff machine according to claim 5 when said means connecting the driven member to the closure operating shaft includes a first sprocket mounted for turning with the driven member and a second sprocket mounted for turning with the operating shaft and a chain connecting the drive and driven sprockets.

10. A wire feeding and cutoff machine according to claim 9 wherein said first sprocket has a larger pitch diameter than said second sprocket.

11. A wire feeding and cutoff machine according to claim 1 wherein said actuator control means includes a gauge rod in the guide passage, a bracket mounted at an end of the stationary guide member, a gauge slide mounted on the bracket for rectilinear movement parallel to the guide passage and having means for adjustably connecting the gauge rod to the gauge slide, means yieldably urging the gauge slide in a direction opposite the direction of advance of wire in the guide passage to a reference position, electrical switch means mounted on the bracket for movement along a path parallel to the guide passage, the switch means having a switch actuator and the gauge slide having cam means engageable with the switch actuator when the gauge slide is moved in a direction away from the reference position, and a screw means threadedly adjustable on the bracket in a direction parallel to said path for adjusting the position of the switch means relative to said reference position.

12. A wire feeding and cutoff machine according to claim 2 wherein said drive and driven members respectively have drive and driven dogs constructed and arranged such that the drive dog moves with the cutoff arm through a preset angle from the initial position before engaging the driven dog.

13. A wire feeding and cutoff machine according to claim 12 including resilient abutment means on one of the dogs for engaging the other of the dogs when the drive member is moved in a first angular direction from the initial position.

14. A wire feeding and cutoff machine according to claim 2 wherein the drive and driven members respectively have drive and driven dogs constructed and arranged such that, when the cutoff arm is in the initial position, the drive dog moves in a first angular direction with the cutoff arm through a first angle before the drive dog engages the driven dog and the drive dog thereafter drives the driven dog in said first angular direction until the cutoff arm is moved in a second angular direction.

15. A wire feeding and cutoff machine comprising, means for continuously advancing wire along a wire path through a cutoff die, an elongated wire guide defining an elongated wire receiving passage for receiving wire advanced through the die and including a stationary guide member and a movable closure member, a closure operating shaft paralleling the wire guide and means operable in response to angular movement of the closure operating shaft for moving the movable closure member between a closed position for guiding wire in the passage and an open position for discharge of the wire laterally from the passage, a cutoff arm mounted for angular movement about a cutoff arm axis paralleling the wire path and a wire cutter mounted on the cutoff arm for movement crosswise of the cutoff die, a drive motor and one-revolution clutch-brake means having an input shaft drivingly connected to the motor and an output shaft and an electroresponsive actuator operable when energized to drive the output shaft through one revolution, eccentric means connecting the output shaft to the cutoff arm for angularly driving the arm during each revolution of the output shaft through a cycle for moving the cutter from an initial position crosswise of the wire path to a cutter bottom dead center position and back to the initial position, the cutter intersecting the wire path during a portion of each cycle, closure operating means for moving the closure member from a closed position to an open position and back to the closed position during said portion of the cycle, said closure operating means including, a drive member mounted for angular movement with the cutoff arm about the cutoff arm axis, a driven member mounted for angular movement about an axis coaxial with the cutoff arm axis and for limited angular lost motion relative to the drive member, means operatively connecting the driven member to the closure operating shaft for moving the closure member to the open condition in response to movement of the driven member in a first angular direction, the driven member being arranged to contact the drive member during angular movement of the driven member in a second angular direction, resilient means urging the closure member to the closed position during movement of the driven member in said second angular direction, and actuator control means including switch means responsive to feeding of a length of wire into the wire receiving passage for actuating the electroresponsive clutch actuator.

16. A wire feeding and cutoff machine according to claim 15 wherein the closure operating means is constructed and arranged to start turning of the operating shaft after the cutoff arm has moved from the initial position through a delay angle at least sufficient to allow the output shaft of the clutch-brake means to reach the speed of the input shaft.

17. A wire feeding and cutoff machine according to claim 15 wherein the cutoff arm and cutter are constructed and arranged such that the cutter moves with the cutoff arm from the initial cutter position through a first preset angle before the cutter intersects the wire path, the drive and driven members being constructed and arranged such that the cutter moves with the cutoff arm from the initial cutter position through a second preset angle greater than said first preset angle before the drive member drives the driven member in said first direction.

18. A wire feeding and cutoff machine according to claim 15 wherein said drive and driven members respectively have drive and driven dogs constructed and arranged such that, the cutoff arm can move from the initial position, through an angle in said first angular direction before the drive dog engages the driven dog.

19. A wire feeding and cutoff machine according to claim 15 including resilient means on one of the dogs for resiliently abutting the other of the dogs when the drive member is moved in said first angular direction.

20. A wire feeding and cutoff machine according to claim 15 wherein the drive and driven members respectively have drive and driven dogs constructed and arranged such that, when the cutoff arm is in the initial position, the drive dog can move in said first angular direction through a first angle before engaging the driven dog.

21. A wire feeding and cutoff machine according to claim 15 wherein said means operatively connecting the driven member to the closure operating shaft is constructed and arranged such that driven member turns the closure operating shaft through an angle substantially greater than the angular movement of the driven member during movement of the cutter arm in said angular first direction.

22. A wire feeding and cutoff machine according to claim 21 wherein the movable closure member is mounted by support arms on the closure operating shaft for angular movement therewith.

23. A wire feeding and cutoff machine according to claim 15 wherein said means connecting the driven member to the operating shaft includes a first sprocket mounted for turning with the driven member and a second sprocket mounted for turning with the operating shaft and a chain connecting the drive and driven sprockets.

24. A wire feeding and cutoff machine according to claim 23 wherein said first sprocket has a larger pitch diameter than said second sprocket.

25. A wire feeding and cutoff machine according to claim 15 including an ejector pin mounted for movement crosswise of said wire receiving passage at a location intermediate ends of the stationary guide member, and ejector pin actuating means responsive to movement of the driven member in said first angular direction for moving the ejector pin across the wire receiving passage in the wire guide to aid discharging a wire therefrom.

26. A wire feeding and cutoff machine according to claim 25 wherein the ejector pin actuating means is operatively connected to said closure operating shaft.

27. A wire feeding and cutoff machine according to claim 15 wherein said actuator control means includes a gauge rod in the guide passage, a bracket mounted at the end of the stationary guide member, a gauge slide mounted on the bracket for rectilinear movement parallel to the guide passage and having means for adjustably connecting the gauge rod to the gauge slide, means yieldably urging the gauge slide in a direction opposite the direction of advance of wire in the guide passage to a reference position, electrical switch means mounted on the bracket for movement along a path parallel to the guide passage, the switch means having a switch actuator and the gauge slide having cam means engageable with the switch actuator when the gauge slide is moved in a direction away from the reference position, and a screw means threadedly adjustable on the bracket in a direction parallel to said path for adjusting the position of the switch means relative to said reference position.

28. A wire feeding and cutoff machine comprising, means for continuously advancing wire along a wire path through a cutoff die, an elongated wire guide defining an elongated wire receiving passage for receiving wire advanced through die and including a stationary guide member and a movable closure member, a cutoff arm mounted for angular movement about a cutoff arm axis paralleling the wire path and a cutter mounted on the cutoff arm for movement crosswise of the cutoff die, a drive motor, indexing type clutch-brake means having an input shaft drivingly connected to the motor and an output shaft and an electroresponsive clutch actuator operable when energized to drive the output shaft with the input shaft through an angle, and actuator control means including a switch responsive to feeding a predetermined length of wire into the wire receiving passage for actuating the electroresponsive clutch actuator, eccentric means connecting the output shaft to the cutoff arm for angularly driving the cutoff arm from an initial position in a first angular direction to move the cutter in a cutting stroke, and closure operating means operatively connected to the movable closure member for moving the movable closure member to the open position, the closure operating means being constructed and arranged to start moving the movable closure member after the cutter has intersected the wire path, at least one ejector pin mounted for movement crosswise of said wire receiving passage at a location intermediate ends of the stationary guide member, ejector pin actuating means operated in time relation with movement of the movable closure member to the open position, for moving the ejector pin across the wire receiving passage in the wire guide to aid discharging a wire therefrom.

29. A wire feeding and cutoff machine comprising, means for continuously advancing wire along a wire path through a cutoff die, an elongated wire guide defining an elongated wire receiving passage for receiving wire advanced through the die and including a stationary guide member and a movable closure member, a guide operating shaft paralleling the wire guide and means operable in response to angular movement of the guide operating shaft for moving the movable closure member between a closed position for guiding wire in the passage and an open position for discharging the wire laterally from the passage, a cutoff arm mounted for angular movement about a cutoff arm axis paralleling the wire path and a wire cutter mounted on the cutoff arm for movement crosswise of the cutoff die, a drive motor and one-revolution clutch-brake means having an input shaft drivingly connected to the motor and an output shaft and an electroresponsive actuator operable when energized to drive the output shaft though one revolution, eccentric means connecting the output shaft to the cutoff arm for angularly driving the arm during each revolution of the output shaft through a cutoff arm cycle from an initial position in which the cutter is adjacent the wire path, said eccentric means being constructed and arranged to drive the cutoff arm sequentially:

(a) in a first angular direction from the initial position to a cutter bottom position for moving the cutter at least part way across the wire path;

(b) in a second angular direction from the cutter bottom position through an intermediate position for moving the cutter clear of the wire path;

(c) in said second angular direction from the intermediate position to a cutter top position for moving the cutter away from the wire path and;

(d) in said first angular direction from the cutter top position back to the initial position to move the cutter back to a position adjacent the wire path, resilient means urging the movable closure member to the closed position, a drive member mounted on the cutoff arm for angular movement with the cutoff arm about the cutoff arm axis, a driven member mounted for angular movement about an axis coaxial with the cutoff arm axis and for limited angular lost motion relative to the drive member, means operatively connecting the driven member to the closure operating shaft to angularly move the latter in response to angular movement of the driven member in said first angular direction, said drive and driven members being constructed and arranged such that the drive member drives the driven member in a said first angular direction during angular movement of the cutoff arm in said first angular direction from the initial position to move the movable guide member to the open position, the driven member being arranged to engage the drive member during angular movement of the cutoff arm in said second angular direction from the cutter bottom position through the intermediate position to allow the movable closure member to move in response to said yieldable means back to the closed position, said drive and driven members being constructed and arranged such that the drive member does not drivingly engage the driven member during movement of the cutoff arm from the intermediate position through the cutter top position and back to the initial position to allow the movable guide member to remain in the closed position during the second half of the revolution of the output shaft, and actuator control means including switch means responsive to feeding of a length of wire into the wire receiving passage for actuating the electroresponsive clutch actuator.

30. A wire feeding and cutoff machine according to claim 29 including an ejector pin mounted for movement crosswise of said wire receiving passage at a location intermediate ends of the stationary guide member, and ejector pin actuating means responsive to movement of the driven member in said first angular direction for moving the ejector pin across the wire receiving passage in the wire guide to aid discharging a wire therefrom.

* * * * *

UNITED STATES PATENT AND TRADEMARK OFFICE

CERTIFICATE OF CORRECTION

PATENT NO. : 5,570,728

DATED : November 5, 1996

INVENTOR(S) : Roger J. Benedict and Craig S, Legault

It is certified that error appears in the above-identified patent and that said Letters Patent is hereby corrected as shown below:

On the title page: INID Code [75], change spelling of surname of second named inventor from "Legaul" to --Legault--

Signed and Sealed this

Fourteenth Day of January, 1997

Bruce Lehman

*Attest:*

BRUCE LEHMAN

*Attesting Officer*

*Commissioner of Patents and Trademarks*